United States Patent [19]

Sung et al.

[11] Patent Number: 4,530,802

[45] Date of Patent: Jul. 23, 1985

[54] DI-HYDROCARBYL PHOSPHATE QUATERNARY AMINE SALTS WITH AN AMIDE OF AN AMINO CARBOXYLIC ACID

[75] Inventors: Rodney L. Sung, Fishkill; William M. Sweeney; Benjamin J. Kaufman, both of Wappingers Falls, all of N.Y.

[73] Assignee: Texaco Inc., White Plains, N.Y.

[21] Appl. No.: 415,110

[22] Filed: Sep. 7, 1982

Related U.S. Application Data

[62] Division of Ser. No. 318,533, Nov. 5, 1981, Pat. No. 4,365,972.

[51] Int. Cl.[3] ..... C07F 9/09

[52] U.S. Cl. ..... 260/925

[58] Field of Search ..... 260/925

[56] References Cited

U.S. PATENT DOCUMENTS 2,508,924 5/1950 Mertens et al. ..... 260/925

4,365,972 12/1982 Sung et al. ..... 44/56

*Primary Examiner*—Anton H. Sutto

*Attorney, Agent, or Firm*—Robert A. Kulason; Carl G. Seutter

[57] ABSTRACT

A novel fuel composition contains ethanol or gasohol plus, as a wear-inhibiting additive, a quaternary ammonium reaction product of dilauryl phosphate and a t-alkyl monoamide of iminodiacetic acid.

12 Claims, No Drawings

DI-HYDROCARBYL PHOSPHATE QUATERNARY AMINE SALTS WITH AN AMIDE OF AN AMINO CARBOXYLIC ACID

RELATED APPLICATIONS

This is a division of application Ser. No. 318,533, filed Nov. 5, 1981, now U.S. Pat. No. 4,365,972 issued Dec. 28, 1982. Related U.S. Pat. No. 4,416,667 was issued on Nov. 22, 1983.

FIELD OF THE INVENTION

This invention relates to a fuel composition for internal combustion engines particularly characterized by corrosion inhibition.

BACKGROUND OF THE INVENTION

As is well known to those skilled in the art, fuel compositions typified by gasohol and alcohols which are to be considered for commercial use must possess low corrosion activity; and this may be effected by addition thereto of various corrosion inhibition systems. It is an object of this invention to provide a fuel composition for internal combustion engines particularly characterized by corrosion inhibition. Other objects will be apparent to those skilled in the art.

STATEMENT OF THE INVENTION

In accordance with certain of its aspects, the fuel composition of this invention may comprise (a) a major portion of a fuel containing (i) at least one alcohol selected from the group consisting of ethanol and methanol and (ii) gasoline in amount of 0–50 volumes per volume of alcohol; and (b) a minor wear-inhibiting amount of, as a wear-inhibiting additive, a quaternary ammonium reaction product of (i) an amide of an amino carboxylic acid and (ii) as a phosphorus ester, a di-hydrocarbyl phosphate.

DESCRIPTION OF THE INVENTION

The fuel for internal combustion engines which may be-treated by the process of this invention may contain (i) at least one alcohol selected from the group consisting of ethanol and methanol and (ii) gasoline in amount of 0–50 volumes per volume of alcohol. The fuel may be an alcohol-type fuel containing little or no hydrocarbon. Typical of such fuels are methanol, ethanol, mixtures of methanolethanol, etc. Commercially available mixtures may be employed. Illustrative of one such commercially available mixture may be that having the following typical analysis.

TABLE I

| Component | Parts |
|---|---|
| ethanol | 3157.2 |
| methyl isobutyl ketone | 126.3 |
| acetic acid | 0.256 |
| methyl alcohol | 0.24 |
| isopropyl alcohol | 0.2 |
| n-propyl alcohol | 0.162 |
| ethyl acetate | 0.2 |

The fuels which may be treated by the process of this invention include gasohols which may be formed by mixing 90–95 volumes of gasoline with 5–10 volumes of ethanol or methanol. A typical gasohol may contain 90 volumes of gasoline and 10 volumes of absolute alcohol.

It is preferred that the fuels to be treated by the process of this invention be substantially anhydrous i.e. that they contain less than about 0.3 v % water; typically they may contain 0.0001 v %–0.005 v %, say about 0.04 v % water.

It is a feature of these fuels that they may undesirably contain acidic contaminants which may cause serious corrosion problems. These contaminants are particularly in evidence when the alcohol is a commercially available alcohol which contains therein inter alia acids concurrently produced as by fermentation processes for producing ethanol or acids which have been picked up during handling. Acetic acid is a common acid present in the commercially available alcohols produced by fermentation; and it may be present in amount of 0.003 w %–0.005 w % of the total of the alcohol.

In accordance with practice of the process of this invention, there may be added to the fuel a minor wear-inhibiting amount of, as a wear-inhibiting additive, a quaternary ammonium reaction product of (i) an amide of an amino mono-carboxylic acid or of an imino dicarboxylic acid or of a nitrilo tricarboxylic acid and (ii) as a phosphorus ester a di-hydrocarbyl phosphate.

The amides of the amino carboxylic acids, i.e. of amino monocarboxylic acids or imino dicarboxylic acids or of nitrilo tricarboxylic acids, which may be used in practice of the process of this invention may be characterized by the formula:

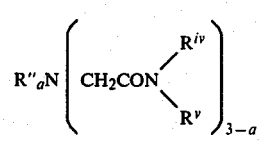

(I)

wherein each of R″, $R^{iv}$, and $R^{v}$ is hydrogen, alkyl, cycloalkyl, alkenyl, alkaryl, aralkyl, or aryl; a is 0, 1 or 2; and at least one of $R^{iv}$ and $R^{v}$ is other than hydrogen.

When a is 2, the formula may be

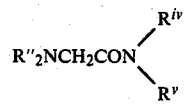

(II)

and the compounds may be considered as derivatives of glycine-amino acetic acid.

When a is 1, the formula may be

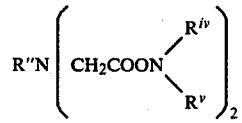

(III)

and the compounds may be considered as derivatives of imino diacetic acid.

When a is 0, the formula may be

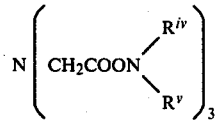

(IV)

and the compounds may be considered as derivatives of nitrilo triacetic acid.

In the above compound, R″ may be hydrogen or a hydrocarbon radical selected from the group consisting of alkyl, aralkyl, cycloalkyl, alkenyl, aryl, and alkaryl, including such radicals when inertly substituted. When R″ is alkyl, it may typically be methyl, ethyl, n-propyl, isopropyl, n-butyl, i-butyl, sec-buty, amyl, octyl, decyl, octadecyl, etc. When R″ is aralkyl, it may typically be benzyl, beta-phenylethyl, etc. When R″ is cycloalkyl, it may typically be cyclohexyl, cycloheptyl, cyclooctyl, 2-methylcycloheptyl, 3-butylcyclohexyl, 3-methylcyclohexyl, ect. When R″ is alkenyl, it may typically be propenyl, butenyl, etc. When R″ is aryl, it may typically be phenyl, naphthyl, etc. When R″ is alkaryl, it may typically be tolyl, xylyl, etc. R″ may be inertly substituted i.e. it may bear a non-reactive substituent such as alkyl, aryl, cycloalkyl, ether, halogen, etc. Typically inertly substituted R″ groups may include 3-chloropropyl, 2-ethoxyethyl, carboethoxymethyl, 4-methylcyclohexyl, p-chlorophenyl, p-chlorobenzyl, 3-chloro-3-methylphenyl, etc. The preferred R″ groups may be hydrogen or lower alkyl, i.e. $C_1$–$C_{10}$ alkyl, groups including e.g. methyl, ethyl, n-propyl, i-propyl, butyls, amyls, hexyls, octyls, decyls, etc. R″ may preferably be hydrogen.

Although the carbon atom adjacent to the carbonyl groups may commonly and preferably bear two hydrogen atoms, it may bear inert substituents. Similarly the other carbon atoms in compound I may preferably bear two hydrogen atoms or other inert substituents.

$R^{iv}$ and $R^{v}$ may be hydrogen or a hydrocarbon group selected from the same group of hydrocarbon groups as that from which R″ is selected.

At least one of $R^{iv}$ and $R^{v}$ is other than hydrogen.

Preferred $R^{iv}$ and $R^{v}$ groups may be hydrogen or hydrocarbons containing at least 12 carbon atoms, preferably 12–24 carbon atoms.

Illustrative compositions may include

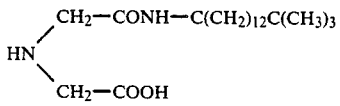

A prepared from imino diacetic acid and primary JMT brand of t-alkyl primary amine.

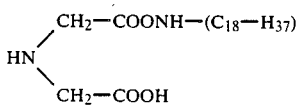

B prepared from imino diacetic acid and Armeen T brand of tallow ($C_{12}$–$C_{18}$) primary amine.

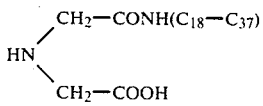

C prepared from imino diacetic acid and Armeen O brand of oleyl ($C_{18}$) primary amine.

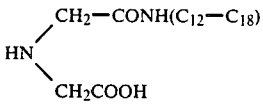

D prepared from imino diacetic acid and Armeen C brand of coco ($C_{12}$–$C_{18}$ unsaturated) primary amine.

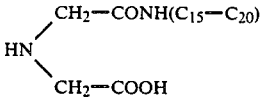

E prepared from imino diacetic acid and Armeen L-15 brand of secondary ($C_{15}$–$C_{20}$) alkyl primary amine.

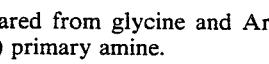

F prepared from glycine and Armeen O brand of oleyl ($C_{18}$) primary amine.

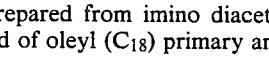

G as prepared from imino diacetic acid and Armeen O brand of oleyl ($C_{18}$) primary amine.

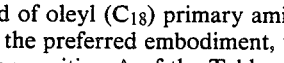

H prepared from nitrilo triacetic acid and Armeen D brand of oleyl ($C_{18}$) primary amine.

In the preferred embodiment, the composition I may be composition A of the Table above.

Preparation of the charge amides which may be used in practice of the process of this invention may be effected by reacting charge amino acid with charge amine. The amino carboxylic acid may be an amino carboxylic acid, an imino dicarboxylic acid or a nitrilo tricarboxylic acid.

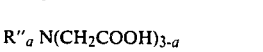

is reacted with charge amine

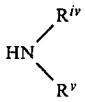

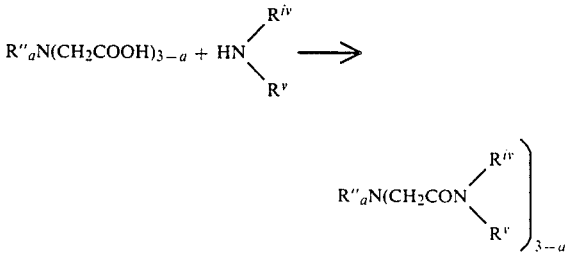

Preparation of the charge amides which may be used in practice of the process of this invention in one embodiment may be carried out by reacting charge amino acid

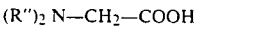

with charge amine

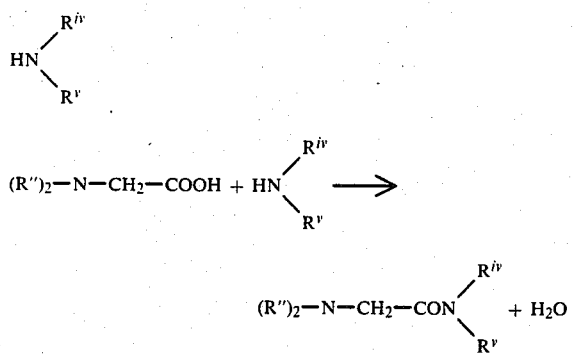

In a preferred embodiment, the reaction (carried out in the presence of refluxing xylene) may be:

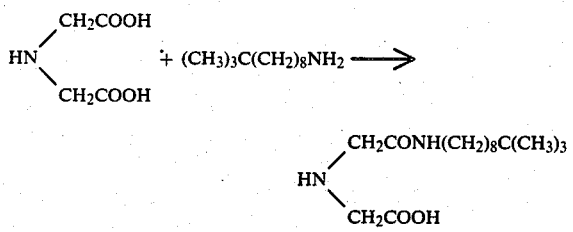

It will be apparent that the amount of amine employed may depend on the number of amide groups to be introduced e.g. whether the charge acid contains one, two or three carboxyl groups and whether it be desired to prepare imino amides, diamides, etc.

Reaction may be carried out by adding one equivalent of acid and 1–1.2 equivalents (preferably 1 equivalent) of amine to a reaction operation together with an excess of an inert solvent. Commonly the solvent may be present in amount corresponding to 0.3–5 ml per gram of reactants, say about 0.45 ml per gram of reactants. Typical inert solvents may include hydrocarbons boiling at 65° C.–200° C. Toluene and xylene may be preferred.

The reaction mixture is heated at 65° C.–200° C., typically 140° C. typically at atmospheric pressure for 8–24 hours, typically 16 hours. It is preferred to operate at reflux temperature. During reaction, by-product water is removed. At the completion of the reaction, the mixture is preferably filtered hot and the solvent removed as by distillation. Reaction product may be analyzed by infra-red spectroscopy and by elemental analysis.

These novel amides may be used as carburetor detergents, corrosion inhibitors for gasoline, etc.

The novel quaternary products of this invention may be prepared by reacting the amides with a phosphorus ester, i.e. a phosphate-ester having the formula:

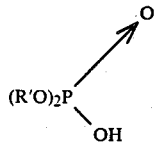

In the above formula, R′ may be a hydrocarbon radical selected from the group consisting of alkyl, aralkyl, cycloalkyl, aryl, and alkaryl, including such radicals when inertly substituted. When R′ is alkyl, it may typically be methyl, ethyl, n-propyl, iso-propyl, n-butyl, i-butyl, secbutyl, amyl, octyl, decyl, octadecyl, etc. When R is aralkyl, it may typically be benzyl, beta-phenylethyl, etc. When R′ is cycloalkyl, it may typically be cyclohexyl, cycloheptyl, cyclooctyl, 2-methylcycloheptyl, 3-butylcyclohexyl, 3-methylcyclohexyl, etc. When R′ is aryl, it may typically be phenyl, naphthyl, etc. When R′ is alkaryl, it may typically be tolyl, xylyl, etc. R′ may be inertly substituted i.e. it may bear a non-reactive substituent such as alkyl, aryl, cycloalkyl, ether, etc. Typically inertly substituted R′ groups may include 2-ethoxyethyl, carboethoxymethyl, 4-methyl cyclohexyl, etc. The preferred R′ groups may be alkyl groups having 1–30 carbon atoms. Preferably the R′ group may contain 8–20, typically 12–14, say 12 carbon atoms.

Illustrative phosphates which may be employed may include:

TABLE

| |
|---|
| di-lauryl phosphate |
| di-decyl phosphate |
| di-pentadecyl phosphate |
| di-hexadecyl phosphate |
| di-heptadecyl phosphate |
| di-octadecyl phosphate |
| di-nonadecyl phosphate |

A preferred phosphate may be di-lauryl phosphate. A commercially available phosphate may be the mixed di ($C_{12}$–$C_{14}$) alkyl phosphate.

Preparation of the novel quaternary products of this invention may be carried out by reacting preferably equimolar quantities of the amide and the phosphorus ester:

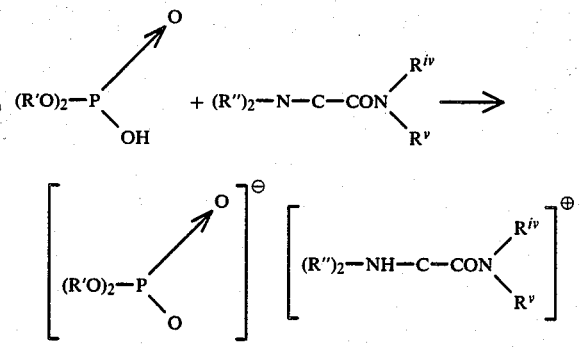

In one typical embodiment wherein dilauryl phosphate is reacted with the tertiary $C_{12}$ alkyl amide of iminodiacetic acid, the reaction may be as follows:

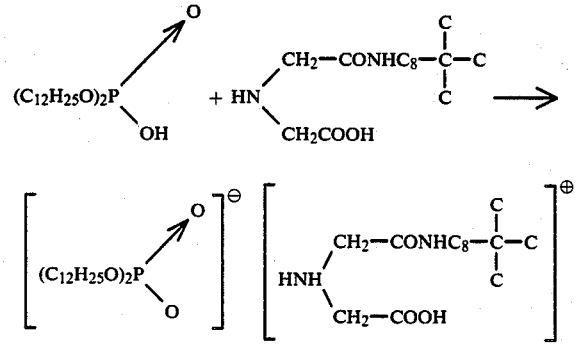

Reaction is typically carried out by mixing substantially equimolar portions of the phosphorus ester (usually a liquid) and the half-amide (also usually a liquid) at 20° C.–100° C., typically 20° C.–50° C., say 25° C. ambient temperature and 10–500 psig, preferably 14.7–100 psig, say 14.7 psig atmospheric pressure for 0.1–4 hours, say 0.5 hours. If desired, reaction may be carried out in the presence of an excess of absolute alcohol, preferably ethanol, or hydrocarbon typically toluene or xylene or isooctane. Reaction product may be employed without further purification.

Typical reaction products include:

TABLE

A.

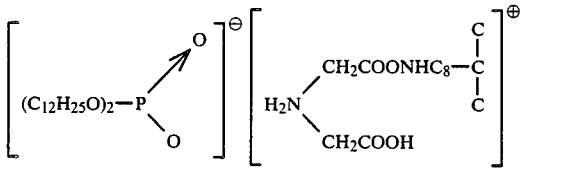

B.

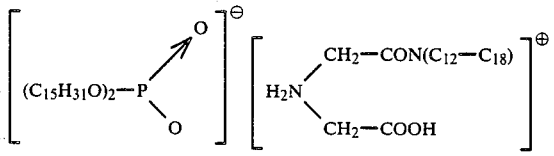

C.

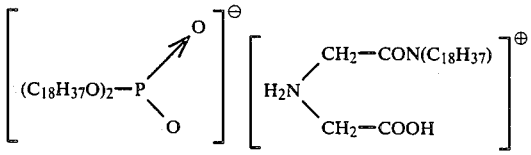

D.

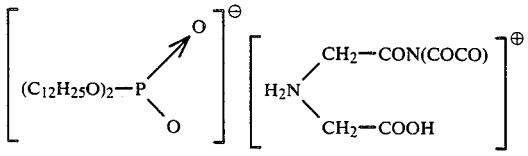

E.

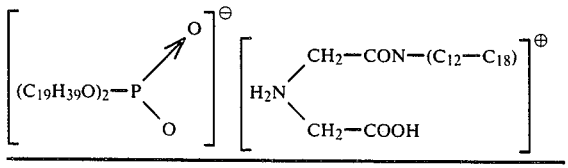

The so-prepared anti-wear additives may be added to fuels (including alcohol, gasoline, gasohol etc.) or to antifreeze. These compositions may be particularly found to be effective when added to absolute alcohol fuels typified by those available commercially containing compounds including ethers, esters, acids, etc.

The so-prepared anti-wear additives may be added to a fuel in amount of 1–2500 PTB, preferably 5–2000 PTB, more preferably 100–1000 PTB, say 350 PTB. (PTB stands for pounds of additive per thousand barrels of fuel). Alternatively expressed, the additive may be added to a fuel in minor wear-inhibiting amount of about 0.003–10 w % preferably 0.01–6 w %, more preferably 0.2–3 w %, say 1 w %. Larger amounts may be employed but may not be necessary.

It is a feature of this invention that the fuel composition so prepared is characterized by its increased ability to significantly reduce scar diameters (wear) in the Four-Ball Wear Test.

The Four Ball Wear Test is carried out by securely clamping three highly polished steel balls (each 0.5 inch in diameter) in a test cup in an equilateral triangle in a horizontal plane. The fourth highly polished steel ball, resting on the three lower balls to form a tetrahedron, is held in a chuck. A weight lever arm system applies weight to the test cup, and this load holds the balls together. In the standard test, the speed of rotation is 1800 rpm; the load is 5 kilograms. The assembly is submerged in the liquid to be tested. The standard test is carried out at ambient temperature for 30 minutes. As the chuck and upper ball rotate against the fixed lower balls, the friction of the upper ball rotating in relation to the lower balls produces a wear-scar the diameter of which (i.e. the depth along a diameter of the ball) is measured. The average of the wear on the three lower balls is the rating assigned (in millimeters).

It is observed that the use of the technique of this invention permits reduction in the average scar diameter by as much as 25%–35%. A reduction of 10% is a significant reduction.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I

In this example which illustrates the best mode known to me of practicing the process of this invention, there is added to 200 ml of xylene, 120 g of iminodiacetic acid and 322 g of the Primene JMT brand of tertiary alkyl primary amine $$(CH_3)_3-CH_2-(CH_2)_x-NH_2$$

wherein x is 8–10. The reaction mixture was refluxed until 19.5 ml of water was recovered. The mixture was filtered hot and the xylene was then removed by distillation. Analysis by infrared and by elemental analysis revealed substantially stoichiometric yield of

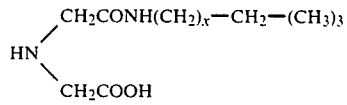

EXAMPLE II

In this example, the monoamide product of Example I is quaternized. There is added to a reaction operation 45 g of the product of Example I and 22 g of the Ortholeum 162 brand of dilauryl acid phosphate. The mixture was thoroughly agitated at ambient temperature of 25° C. for 30 minutes. The quaternary product, which may be used as is, contains

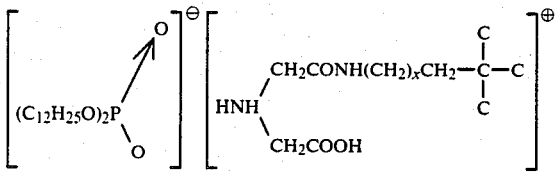

EXAMPLE III

In this example, a formulation is made up containing 1 w % of the product of Example II in absolute ethanol; and this formulation is tested in the four ball test for 30 minutes at ambient temperature using a load of 5 Kg and a speed of 1800 rpm. The average of five runs is determined. The average Scar Diameter is 0.332 millimeter.

EXAMPLE IV

In this control example, the procedure of Example III was carried out except that the four ball test was run on pure absolute ethanol. The Average Scar Diameter of runs) was 0.4775 millimeter.

It is apparent that use of the process of this invention desirably increased the wear-inhibiting property of the ethanol by 43% (i.e. 0.4775/0.332).

Results comparable to those of Example I may be obtained if the amine is:

TABLE

| Example | Amine |
|---|---|
| V | Armeen T brand of tallow ($C_{12}$–$C_{18}$) amine |
| VI | Armeen O brand of oleyl ($C_{18}$) amine |
| VII | Armeen C brand of COCO (principally saturated $C_{12}$ $C_{14}$–$C_{18}$) amine |
| VIII | Armeen L-15 brand of $C_{15}$–$C_{20}$ secondary primary amine |

Results comparable to those of Example I may be obtained if the acid is:

TABLE

| Example | Acid |
|---|---|
| IX | $H_2NCH_2COOH$ |
| X | $N(CH_2COOH)_3$ |
| XI | $CH_3NHCH_2COOH$ |
| XII | $C_2H_5NHCH_2COOH$ |

Results comparable to those of Example III may be obtained if the phosphorus ester is:

TABLE

| Example | Phosphorus Ester |
|---|---|
| XIII | di-decyl phosphate |
| XIV | di-pentadecyl phosphate |
| XV | di-hexadecyl phosphate |
| XVI | di-octadecyl phosphate |
| XVII | di-nonadecyl phosphate |

Results comparable to those of Example III may be obtained if the fuel is as follows:

TABLE

| Example | Fuel |
|---|---|
| XVIII | Gasohol containing 90 v % gasoline and 10 v % absolute ethanol |
| XIX | absolute methanol |
| XX | diesel oil |

Although this invention has been illustrated by reference to specific embodiments, it will be apparent to those skilled in the art that various changes and modifications may be made which clearly fall within the scope of this invention.

We claim:

1. A novel composition comprising

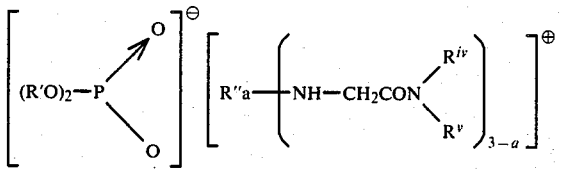

wherein R′ is alkyl, alkaryl, aralkyl, cycloalkyl, or aryl; each of R″, $R^{iv}$ and $R^{v}$ is hydrogen, alkyl, cycloalkyl, alkenyl, alkaryl, aralkyl, or aryl; a is 0, 1, or 2; and at least one of $R^{iv}$ and $R^{v}$ is other than hydrogen.

2. A novel composition comprising the quaternary reaction product of (i) an amide of an amino carboxylic acid and (ii) as a phosphorus ester, di-hydrocarbyl phosphate.

3. A novel composition as claimed in claim 2 wherein said amide is an amide of imino diacetic acid.

4. A novel composition as claimed in claim 2 wherein said amide has the formula

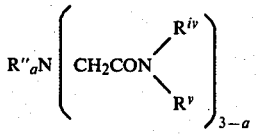

wherein each of R″, $R^{iv}$ and $R^{v}$ is hydrogen, alkyl, cycloalkyl, alkenyl, alkaryl, aralkyl, or aryl; a is 0, 1 or 2; and at least one of $R^{iv}$ and $R^{v}$ is other than hydrogen.

5. A novel composition as claimed in claim 2 wherein said amide has the formula

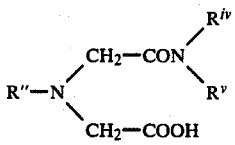

6. A novel composition as claimed in claim 2 wherein said amide has the formula

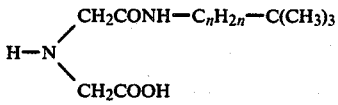

wherein n is an integer 0–10.

7. A novel composition as claimed in claim 2 wherein said amide has the formula

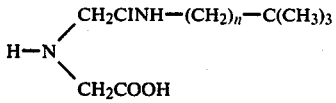

8. A novel composition as claimed in claim 2 wherein said amide has the formula

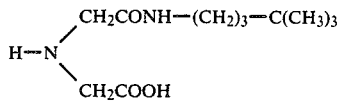

9. A novel composition as claimed in claim 2 wherein said phosphorus ester has the formula

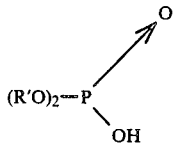

wherein R′ is alkyl, alkaryl, aralkyl, cycloalkyl, or aryl.

10. A novel composition as claimed in claim 2 wherein said phosphorus ester is an alkyl phosphate ester.

11. A novel composition as claimed in claim 2 wherein said phosphorus ester is dilauryl phosphate

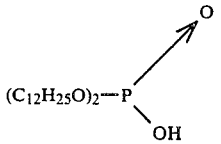

12. A novel composition as claimed in claim 2 wherein said phosphorus ester is di-decyl phosphate

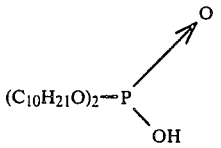

* * * * *